US011012783B2

(12) United States Patent
Kim et al.

(10) Patent No.: US 11,012,783 B2
(45) Date of Patent: May 18, 2021

(54) YOKE FOR SPEAKER HAVING HETEROGENEOUS MATERIAL AND IRON-BASED MATERIAL INTEGRALLY MOLDED, METHOD OF MANUFACTURING THE SAME, AND SPEAKER APPARATUS INCLUDING YOKE FOR SPEAKER

(71) Applicants: HYUNDAI MOTOR COMPANY, Seoul (KR); KIA MOTORS CORPORATION, Seoul (KR)

(72) Inventors: Mi Ru Kim, Hwaseong-si (KR); Do Hoon Kim, Suwon-si (KR); Jin Hyeon Lee, Busan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/535,428

(22) Filed: Aug. 8, 2019

(65) Prior Publication Data

US 2020/0186929 A1 Jun. 11, 2020

(30) Foreign Application Priority Data

Dec. 6, 2018 (KR) ..... 10-2018-0156326

(51) Int. Cl.
*H04R 9/06* (2006.01)
*H04R 31/00* (2006.01)

(52) U.S. Cl.
CPC ..... *H04R 9/06* (2013.01); *H04R 31/00* (2013.01)

(58) Field of Classification Search
None
See application file for complete search history.

(56) References Cited

U.S. PATENT DOCUMENTS

2006/0233415 A1* 10/2006 Chung ..... H04R 9/025 381/396
2014/0169615 A1* 6/2014 Kristiansen ..... H04R 9/025 381/412
2015/0078610 A1* 3/2015 Voishvillo ..... H04R 9/02 381/396

FOREIGN PATENT DOCUMENTS

CN 107876753 * 4/2018 ..... B22F 1/0059
JP 5921199 B2 * 5/2016 ..... F21V 29/507
KR 10-2006-0109172 A 10/2006
KR 10-0661921 B1 12/2006

* cited by examiner

*Primary Examiner* — Walter F Briney, III
(74) *Attorney, Agent, or Firm* — Morgan, Lewis & Bockius LLP

(57) ABSTRACT

A yoke for the speaker includes: a parent member molded of an iron-based powder; and a heterogeneous material molded of a metal powder having a higher conductivity and a lower magnetic susceptibility than the iron-based powder, wherein the heterogeneous material is integrally disposed on at least one of a part of a surface of the parent member, or an internal portion of the parent member, or both, and the heterogeneous material diverts an eddy current generated in the parent member.

17 Claims, 12 Drawing Sheets

[FIG. 1]
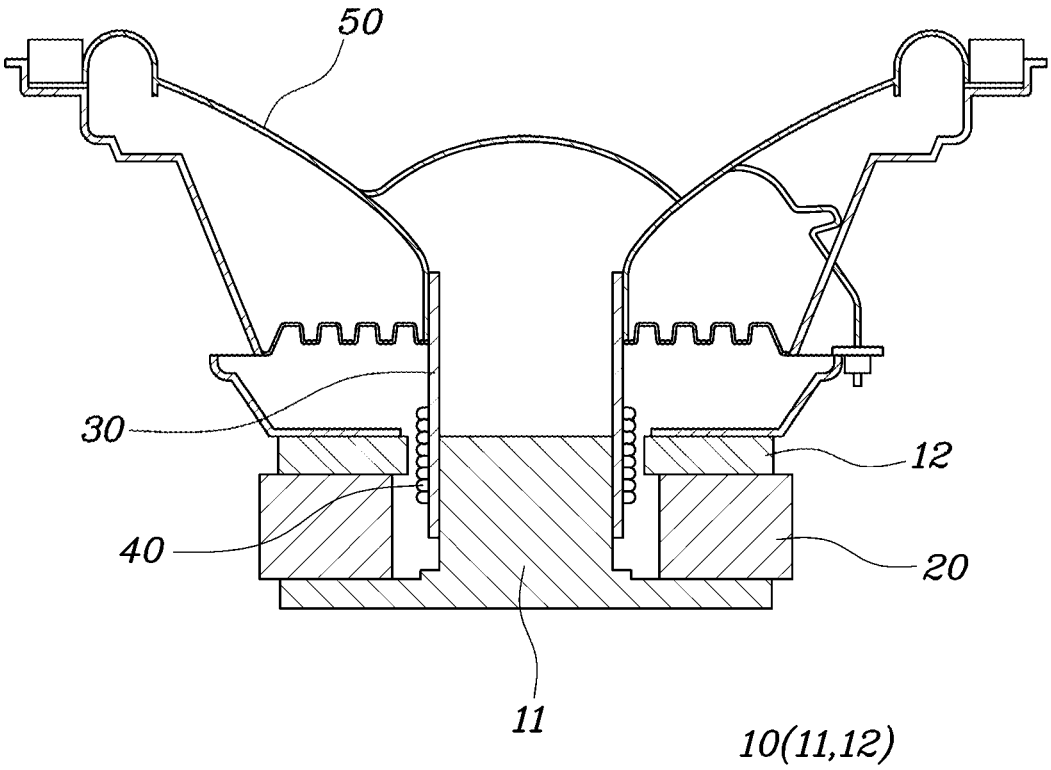
-PRIOR ART-

[FIG. 2]
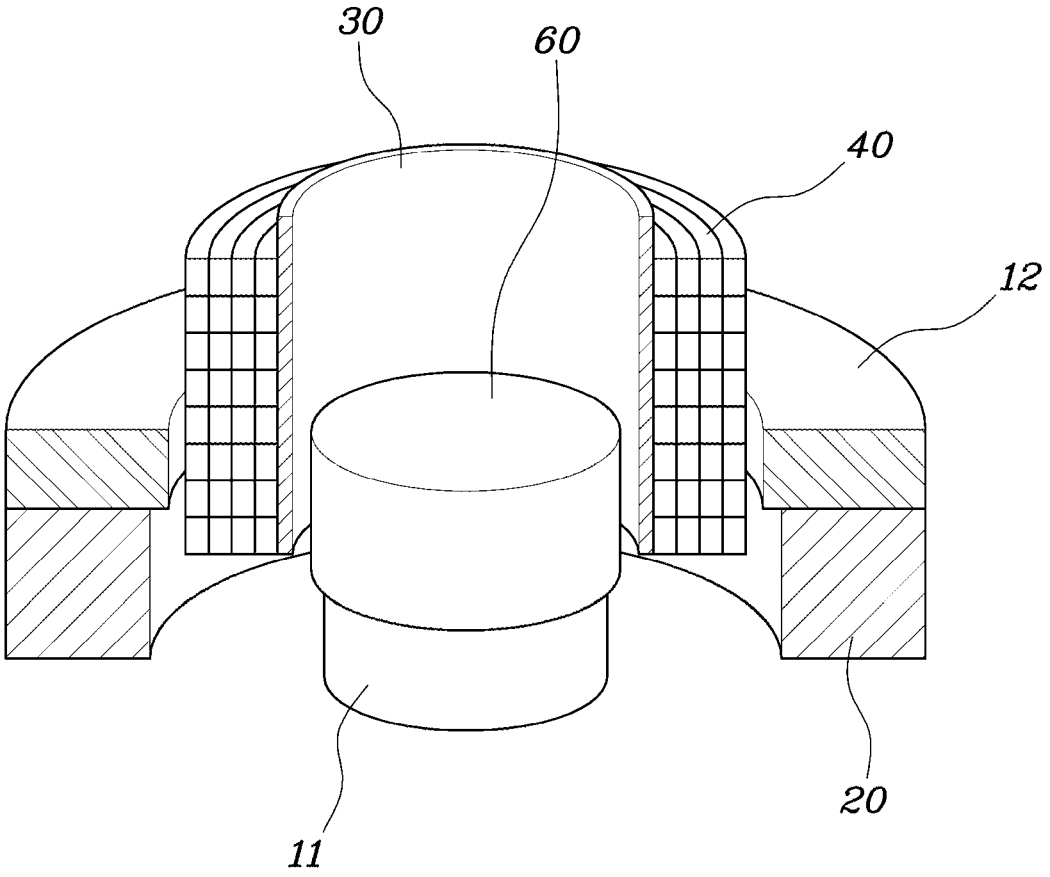
-PRIOR ART-

[FIG. 3]
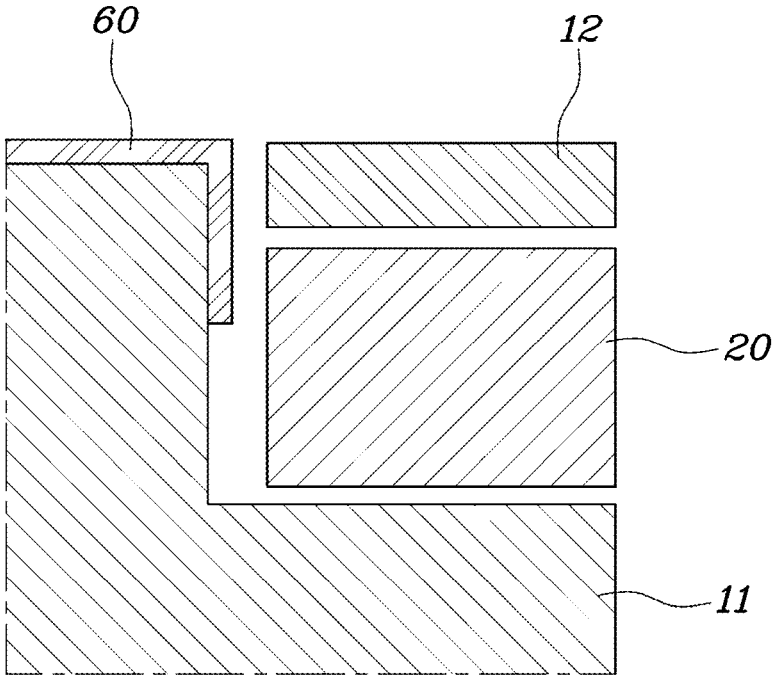
-PRIOR ART-

[FIG. 4]
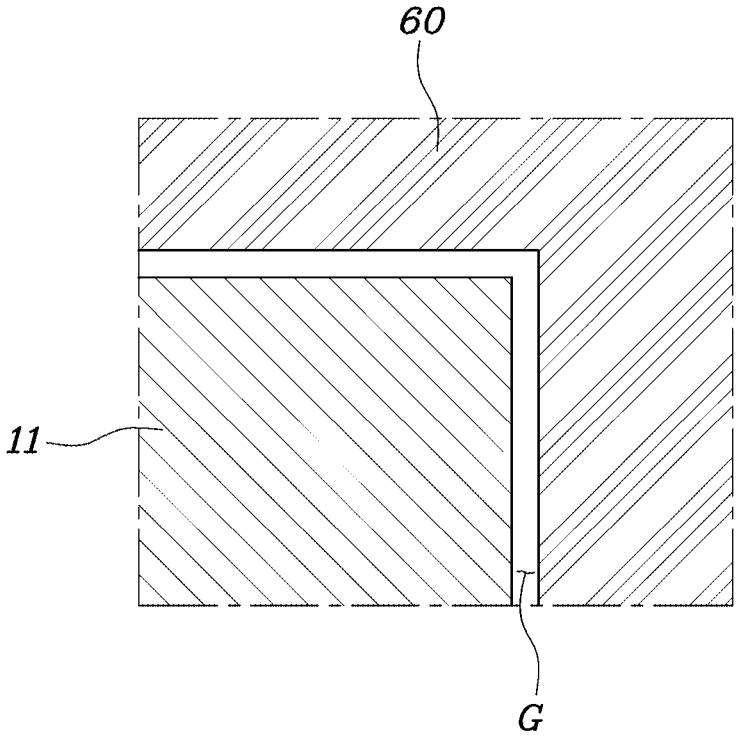
-PRIOR ART-

[FIG. 5]
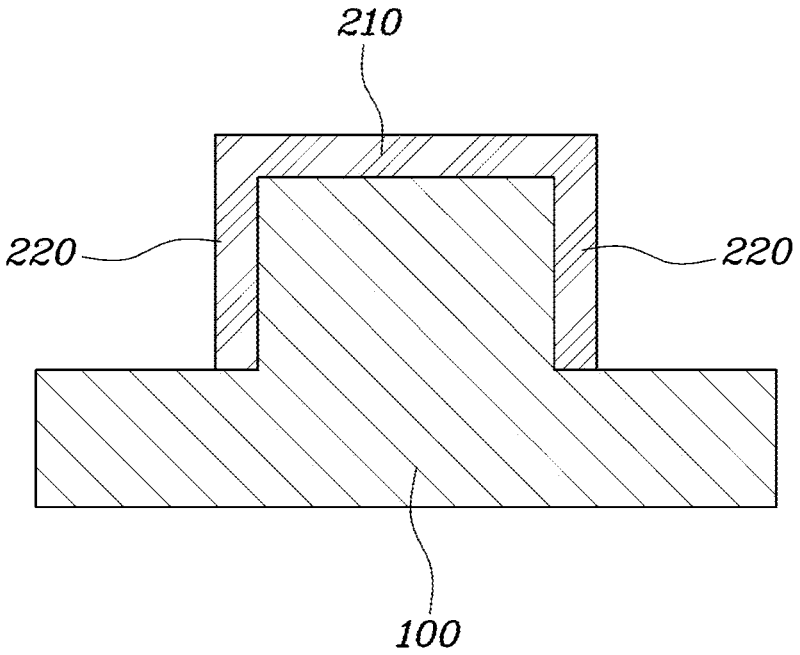
[FIG. 6]
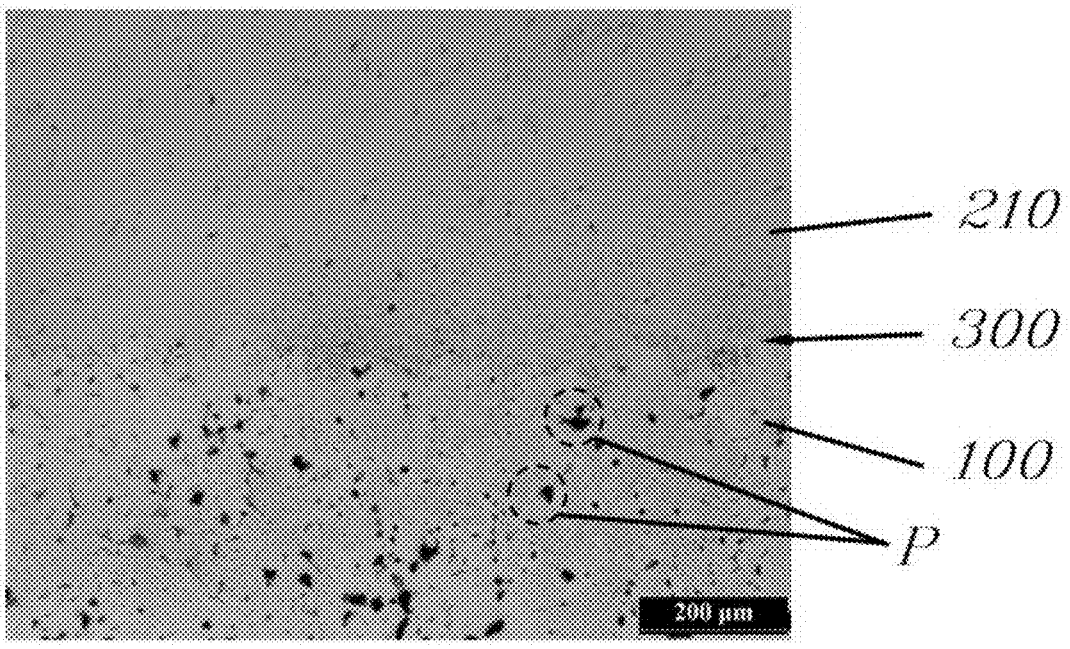

[FIG. 7]
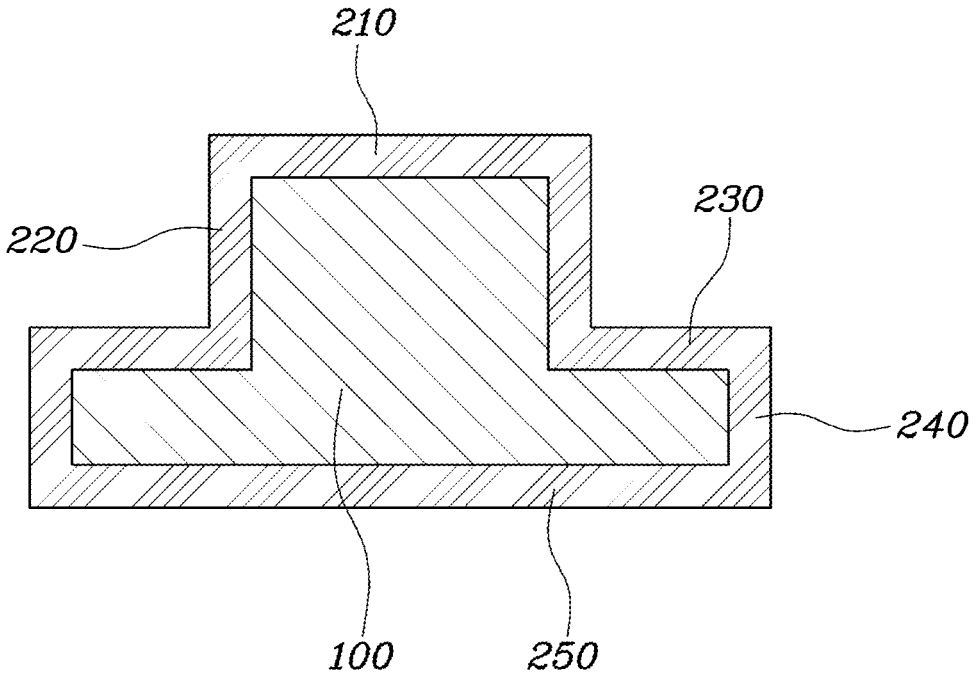
[FIG. 8]
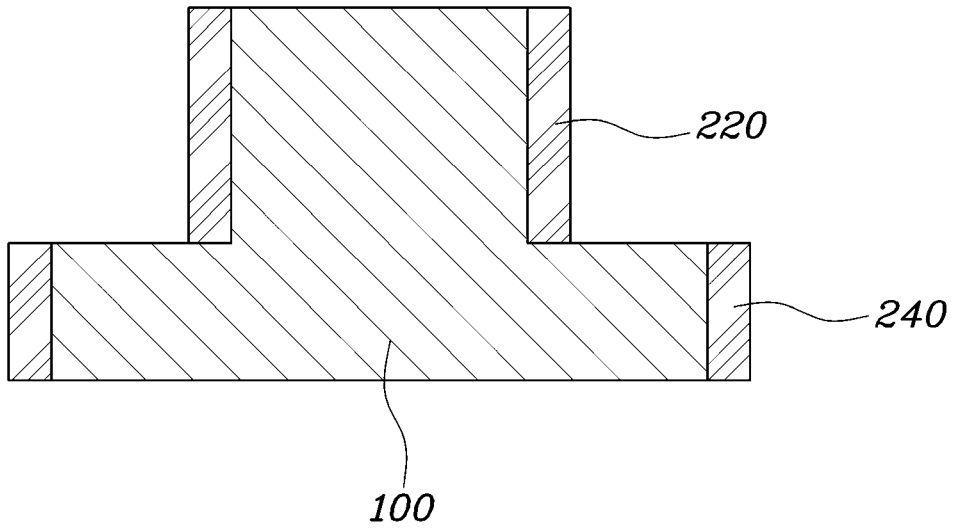

[FIG. 9]
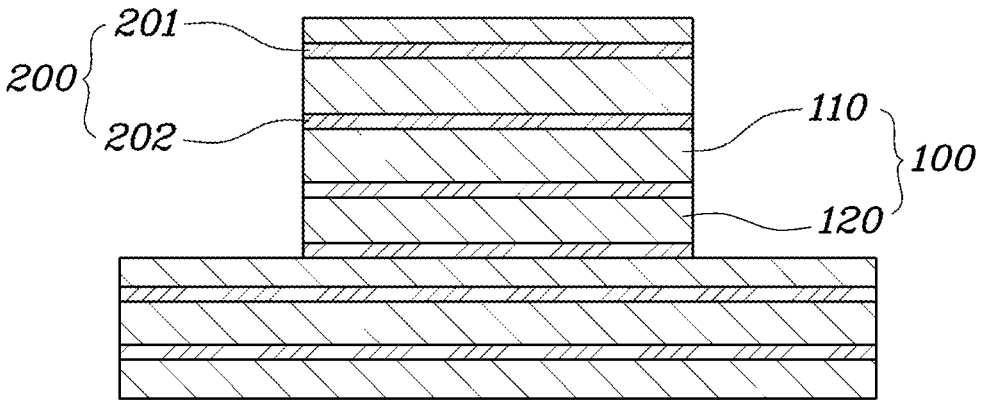

[FIG. 10A]
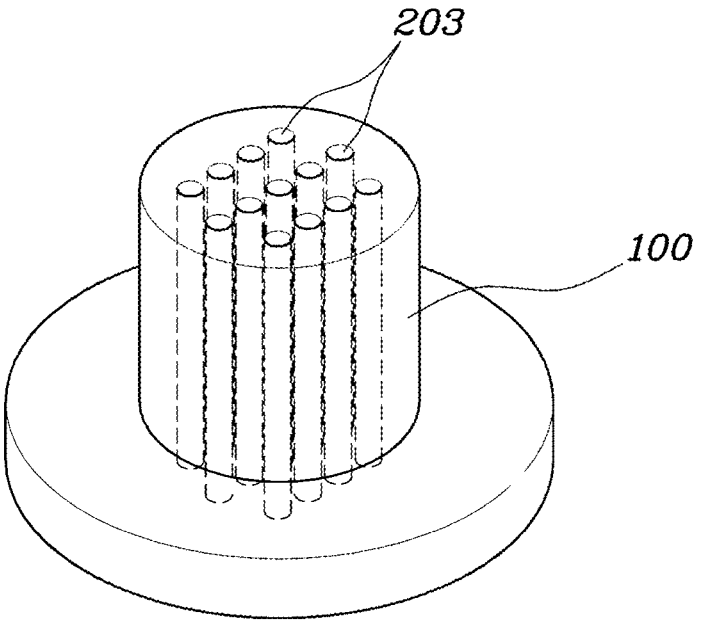
[FIG. 10B]
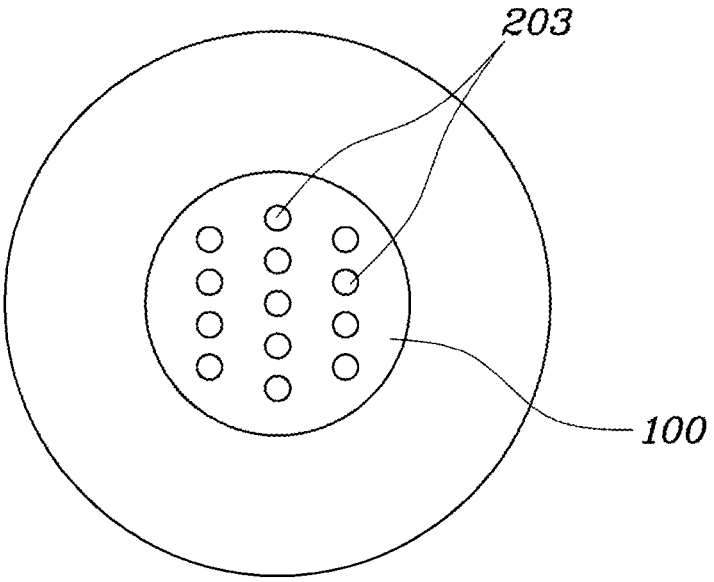

[FIG. 11A]
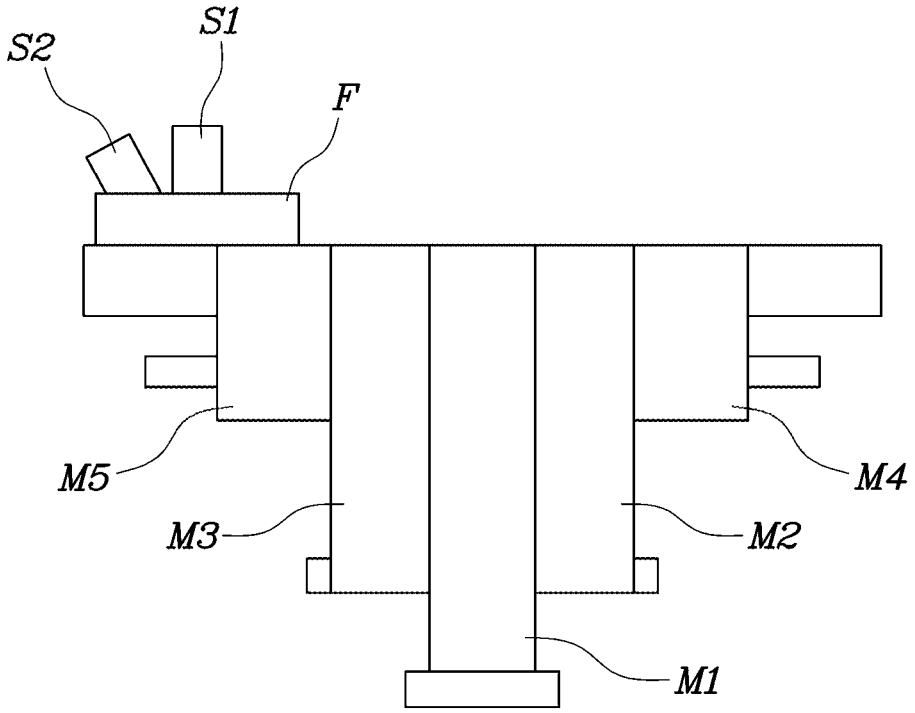

[FIG. 11B]
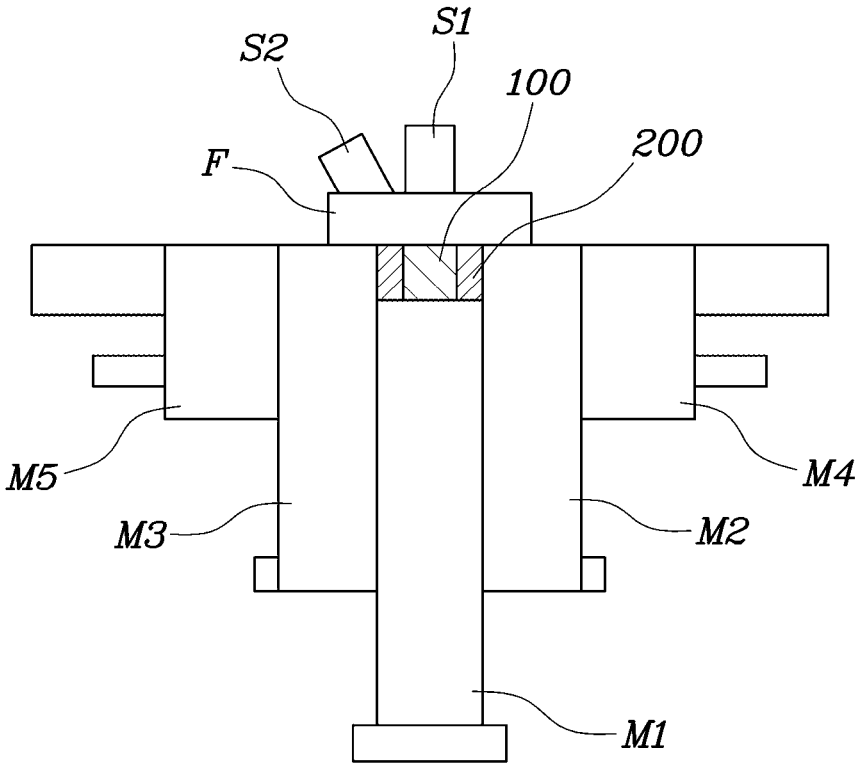

[FIG. 11C]
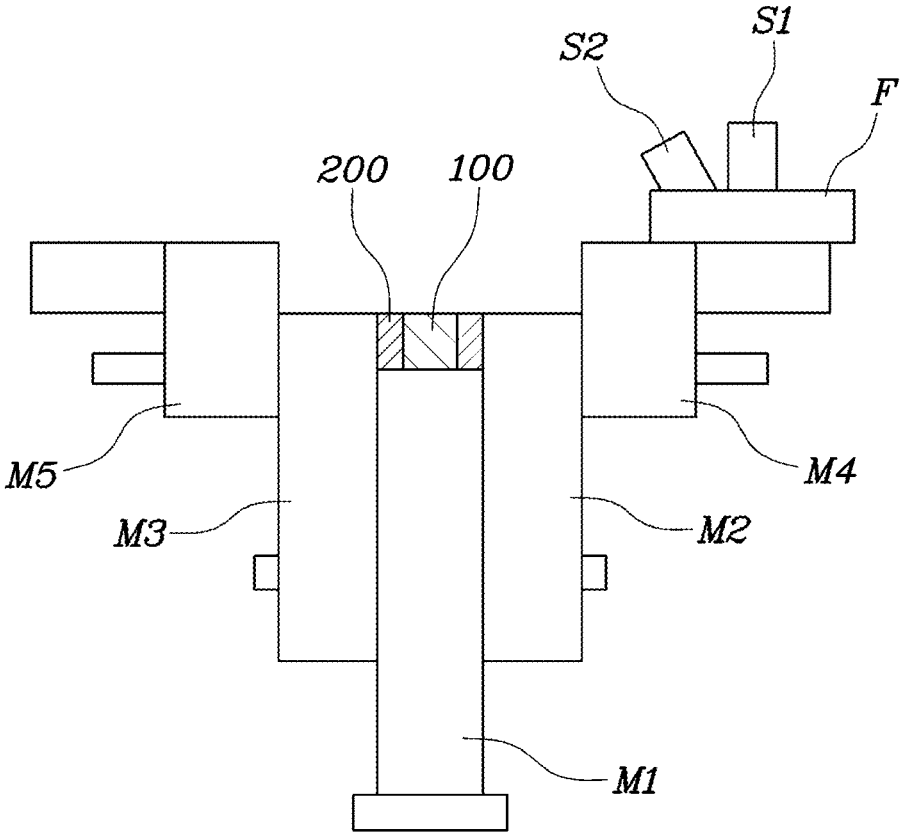

[FIG. 11D]
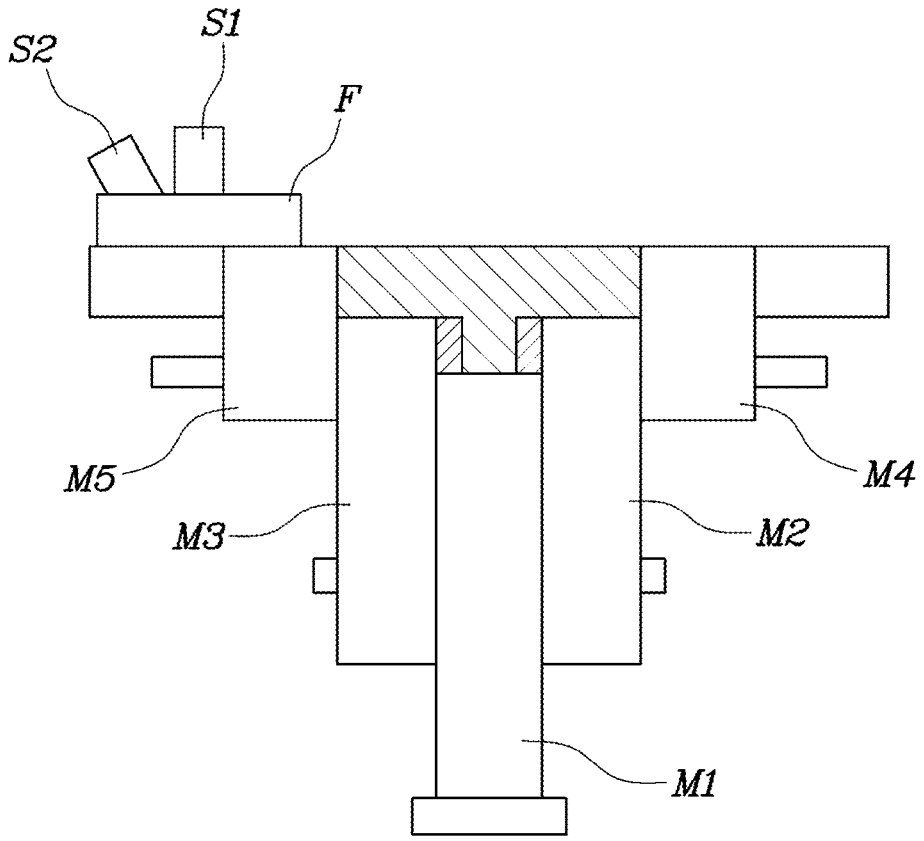

YOKE FOR SPEAKER HAVING HETEROGENEOUS MATERIAL AND IRON-BASED MATERIAL INTEGRALLY MOLDED, METHOD OF MANUFACTURING THE SAME, AND SPEAKER APPARATUS INCLUDING YOKE FOR SPEAKER

CROSS REFERENCE TO RELATED APPLICATION

The present application claims priority to Korean Patent Application No. 10-2018-0156326, filed in the Korean Intellectual Property Office on Dec. 6, 2018, the entire contents of which is incorporated herein for all purposes by this reference.

TECHNICAL FIELD

The present disclosure relates to a yoke for a speaker, a method of manufacturing the same, and a speaker apparatus including the yoke for the speaker, for enhancing sound quality while preventing and diverting eddy current.

BACKGROUND

A speaker apparatus converts an electrical signal into a mechanical signal in the form of sound that is audible by the human through a medium such as air.

FIG. 1 is a diagram showing a general speaker apparatus. As shown in FIG. 1, the general speaker apparatus includes a yoke 10, a magnet 20, a bobbin 30, a voice coil 40, and a diaphragm 50. In this case, the yoke 10 is divided into a lower yoke 10 and an upper yoke 10. Accordingly, during an operation of the speaker apparatus, the voice coil 40 vibrates along with a change in current flowing in the voice coil 40 in a magnetic field formed by the magnet 20, and the vibration of the voice coil 40 is transferred to the diaphragm 50 through the bobbin 30, and accordingly, the diaphragm 50 vibrates to form a sound.

However, when undesired eddy current is formed in the yoke 10 during the operation of the speaker apparatus, a flux is formed in an opposite direction to a desired direction due to the eddy current, which degrades sound quality.

In particular, the yoke 10 is manufactured by molding an iron-based bulk including pure iron and an iron-based alloy via forging, and in this regard, the yoke 10 manufactured via forging as such has a dense internal structure, and thus, there is a problem in that eddy current is easily generated to degrade sound quality.

Accordingly, in order to prevent sound quality from being degraded, methods of reducing the amplitude of the eddy current generated in the yoke or diverting the path of the eddy current generated in the yoke have been proposed.

For example, a method of reducing a path of the eddy current by a pore to reduce the amplitude of the eddy current when the eddy current is generated in the yoke as the yoke is molded via powder molding to form the pore therein has been used.

As a method of diverting the path of the eddy current generated in the yoke, a technology for applying a copper cap to the yoke has been proposed.

FIG. 2 is a diagram showing an internal view of the conventional speaker apparatus. FIGS. 3 and 4 are cross-sectional views showing main parts of the conventional speaker apparatus. As shown in FIGS. 2 and 3, in the conventional speaker apparatus, to divert the eddy current, a copper cap 60 is applied to a yoke. Copper has properties whereby current flows therethrough but does not have magnetism, and thus, the eddy current formed in the yoke 10 is diverted to the copper cap 60 to prevent the eddy current generated in the yoke 10 from interfering with vibration of the voice coil 40. Then, a magnetic flux due to air is formed around the copper cap 60, but copper itself does not form a magnetic flux, and thus, only a weak magnetic flux is formed in the air to minimize degradation of sound quality.

However, the copper cap 60 applied to the conventional speaker apparatus is separately manufactured from the yoke 10 and is assembled therewith, and thus, as shown in FIG. 4, an air gap G is inevitably formed between the copper cap 60 and the yoke 10, and the air gap G obstructs transmission of the eddy current generated in the yoke to the copper cap 60. Accordingly, although the copper cap 60 is applied, there is a problem in that enhancement in degradation of sound quality is incomplete.

The contents described as the related art have been provided only to assist in understanding the background of the present disclosure and should not be considered as corresponding to the related art known to those having ordinary skill in the art.

SUMMARY

An object of the present disclosure is to provide a method of manufacturing the same, and a speaker apparatus including the yoke for the speaker, for enhancing sound quality while preventing and diverting eddy current.

According to an embodiment of the present disclosure, a yoke for a speaker includes: a parent member molded of an iron-based powder; and a heterogeneous material molded of a metal powder having a higher conductivity and a lower magnetic susceptibility than the iron-based powder, wherein the heterogeneous material is integrally disposed on at least one of a part of a surface of the parent member, or an internal portion of the parent member, or both and divert san eddy current generated in the parent member.

The iron-based powder and the metal powder may have particles having a diameter equal to or less than 180 μm.

The iron-based powder and the metal powder may have particles having a diameter of 120 to 180 μm.

The heterogeneous material may have a thickness equal to or less than 7.5 mm.

The heterogeneous material may have a thickness of 5 to 7.5 mm.

The parent member and the heterogeneous material may be alternately stacked in a layer structure.

The heterogeneous material may be integrally disposed on the parent member in a bar shape.

The iron-based powder may be a pure iron powder.

The iron-based powder may be alloy powder including at least one element selected from the group consisting of silicon (Si), phosphorus (P), manganese (Mn), aluminium (Al), and nickel (Ni) in pure iron.

The metal powder may include any one powder of silver (Ag), copper (Cu), gold (Au), chromium (Cr), aluminium (Al), tungsten (W), zinc (Zn), and brass or alloy powder thereof.

The metal powder may be a copper powder.

According to another embodiment of the present disclosure, a method of manufacturing a yoke for a speaker includes steps of: preparing an iron-based powder and a metal powder which has a higher conductivity and a lower magnetic susceptibility than the iron-based powder; molding a parent member of the iron-based powder in the form of a yoke, wherein the metal powder is added to at least one of a part of an a surface of the parent member or an internal portion of the parent member to form a heterogeneous material, and the parent member and the heterogeneous material are molded to be integrated into each other; and annealing the integrally molded parent member and heterogeneous material under a sintering atmosphere of the metal powder.

The iron-based powder and the metal powder that are prepared in the preparing may have particles having a diameter equal to or less than 180 μm, and the molding may include molding the iron-based powder and the metal powder using a compression-molding method.

The iron-based powder may be alloy powder including pure iron powder or at least one element selected from the group consisting of silicon (Si), phosphorus (P), manganese (Mn), aluminium (Al), and nickel (Ni) in pure iron, and the metal powder may include any one powder of silver (Ag), copper (Cu), gold (Au), chromium (Cr), aluminium (Al), tungsten (W), zinc (Zn), and brass or alloy powder thereof.

The annealing may be performed for one hour to one hour and 30 minutes at 830 to 840° C.

According to another embodiment of the present disclosure, a speaker apparatus having a voice coil between a yoke and a magnet and to transmit vibration generated via an interaction between an electric field formed by supplying a current to the voice coil and a magnetic field formed by the magnet to a diaphragm to generate a sound, wherein the yoke includes: a parent member molded of an iron-based powder; and a heterogeneous material molded of a metal powder having a higher conductivity and a lower magnetic susceptibility than the iron-based powder, wherein the heterogeneous material is integrally disposed on at least one of a part of a surface of the parent member, or an internal portion of the parent member, or both, and diverts an eddy current generated in the parent member.

The heterogeneous material may be at least partially disposed on the surface of the parent member, which corresponds to a direction parallel to a vibration direction of the diaphragm.

The parent member and the heterogeneous material may be alternately stacked in a layer structure, and the heterogeneous material may be disposed in a direction parallel to the vibration direction of the diaphragm.

The heterogeneous material may have a bar shape in a horizontal direction to a vibration direction of the diaphragm in the parent member.

BRIEF DESCRIPTION OF THE DRAWINGS

FIGS. 1 and 2 are diagrams showing a conventional speaker apparatus.

FIGS. 3 and 4 are cross-sectional views showing main parts of a conventional speaker apparatus.

FIG. 5 is a cross-sectional view of a yoke for a speaker according to an embodiment of the present disclosure.

FIG. 6 is an image of a boundary surface of a parent member and a heterogeneous material of a yoke for a speaker according to an embodiment of the present disclosure.

FIGS. 7 to 9, 10A, and 10B are diagrams showing a yoke for a speaker according to another embodiment of the present disclosure.

FIGS. 11A, 11B, 11C, and 11D are diagrams showing a procedure of molding a yoke for a speaker according to an embodiment of the present disclosure.

DETAILED DESCRIPTION OF THE EMBODIMENTS

Hereinafter, a folding personal mobility vehicle according to embodiments of the present disclosure will be described with reference to the accompanying drawings. The present disclosure may, however, be embodied in many different forms and should not be construed as being limited to the embodiments set forth herein. Rather, these embodiments are provided so that this disclosure will be thorough and complete, and will fully convey the concept of the present disclosure to those skilled in the art. Like reference numerals in the drawings denote like elements.

FIG. 5 is a cross-sectional view of a yoke for a speaker according to an embodiment of the present disclosure.

As shown in the drawing, the yoke for the speaker according to the present disclosure may be a yoke used in a speaker apparatus, and as shown in FIG. 1, the speaker apparatus may include a yoke 10, a magnet 20, a bobbin 30, a voice coil 40, and a diaphragm 50. In this case, the voice coil 40 may be disposed between the yoke 10 and the magnet 20. Accordingly, vibration generated via an interaction between an electric field formed by supplying current to the voice coil 40 and a magnetic field generated from the magnet 20 may be transmitted to the diaphragm 50 and the diaphragm 50 may vibrate to form a sound. The magnet 20, the bobbin 30, the voice coil 40, and the diaphragm 50 may use components used in a conventional general speaker apparatus without change, and thus, a detailed description of each component in the present disclosure is omitted.

However, according to the present disclosure, a conventional yoke may be enhanced to prevent generation of eddy current generated from the yoke or divert a path of the eddy current.

The yoke may include a parent member 100 that is molded of iron-based powder, and heterogeneous materials 210 and 220 that are molded of metal powder with higher conductivity and lower magnetic susceptibility than the iron-based powder. The heterogeneous materials 210 and 220 are molded to be integrated into at least a partial region of a surface and an internal portion of the parent member 100 to divert eddy current generated in the parent member 100. That is, the heterogeneous material 210 can be integrally disposed on a surface of the parent member 100 partially or an internal portion of the parent member 100, or can be integrally disposed on the surface of the parent member 100 partially and the internal portion of the parent member 100.

Therefore, the present disclosure may include an embodiment where the heterogeneous material may be integrally disposed only on a surface of the parent member, another embodiment where the heterogeneous material may be integrally disposed only on an internal portion of the parent member, and further another embodiment where the heterogeneous material may be integrally disposed both on a surface and an internal portion of the parent member.

The parent member 100 may be a component that functions as a frame configuring a magnetic circuit and forming an accommodation space, and may be manufactured by compression-molding iron-based powder. In this case, the iron-based powder for forming the parent member 100 may be molded by compressing pure iron powder.

The parent member 100 is however not limited to the case in which the parent member 100 is molded using pure iron powder. The parent member 100 may be molded using alloy powder obtained by adding various alloy elements to pure iron for enhancing the functionality of the yoke.

For example, the alloy powder may include at least one alloy element selected from the group consisting of silicon (Si), phosphorus (P), manganese (Mn), aluminium (Al), and nickel (Ni) in pure iron.

In this case, silicon (Si) increases the resistivity of the parent member 100 to reduce loss in eddy current. When 6.5 wt % of Si or greater is added, moldability is degraded, and thus, content thereof may be limited to 6.5% or less.

Phosphorus (P) increases the resistivity of the parent member 100 and increases magnetism. However, when excessive content of P is added, moldability is degraded, and thus, content thereof may be limited to 1 wt % or less.

Manganese (Mn) forms coarse precipitate. However, when Mn with content less than 0.1 wt % is added, minute MnS precipitate may degrade magnetism. Accordingly, 0.1 wt % of Mn or greater may be added to prevent S components from being precipitated as more minute precipitate, CuS, while MnS precipitate is coarsely formed, thereby preventing magnetism from being degraded. However, when excessive content greater than 2.0 wt of Mn is added, magnetism is rather degraded, and thus, content of Mn may be 0.1 to 2.0% wt.

Aluminium (Al) increases resistivity to reduce loss in eddy current. When Al is added with content less than 0.3 wt %, AlN is minutely precipitated to degrade magnetism, and when Al is added with content greater than 2.0 wt %, processability is degraded, and thus, content of Al may be limited to 0.3 to 2.0 wt %.

When nickel (Ni) is added, degradation of magnetic property is low, but strength and magnetic permeability are increased. However, excessive content of Ni is added, magnetic flux density is lowered, and thus, content of Ni may be limited to 50 wt % or less.

The heterogeneous materials 210 and 220 may divert a path of eddy current generated in the parent member 100. To this end, the heterogeneous materials 210 and 220 formed of metal powder have properties whereby current flows therethrough but does not have magnetism. The heterogeneous materials 210 and 220 may include metal powder with a higher conductivity and lower magnetic susceptibility than iron-based powder for forming the parent member 100. For example, a material of the heterogeneous materials 210 and 220 may be metal with higher conductivity than iron (Fe), for example, silver (Ag), copper (Cu), gold (Au), chromium (Cr), aluminium (Al), tungsten (W), zinc (Zn), brass, and nickel (Ni). However, nickel (Ni) has lower magnetic susceptibility than iron (Fe) but has magnetic susceptibility at a level to have magnetism. Thus, according to the present disclosure, nickel (Ni) may not be appropriate for a material of the heterogeneous materials 210 and 220. Accordingly, the metal powder used as the material of the heterogeneous materials 210 and 220 may be any one powder of silver (Ag), copper (Cu), gold (Au), chromium (Cr), aluminium (Al), tungsten (W), zinc (Zn), and brass or alloy powder thereof.

In particular, the metal powder used as the material of the heterogeneous materials 210 and 220 may be copper (Cu) powder that has a similar annealing temperature for removing internal stress and a similar sintering temperature of a material to iron-based powder in such a way that annealing is performed in a condition of sintering metal powder after the metal powder is molded to sinter the metal powder and, simultaneously, to remove internal stress of a parent member formed of iron-based powder. Accordingly, hereinafter, the case in which the material of the heterogeneous materials 210 and 220 is limited to copper powder will be described, but metal powder used as the material of the heterogeneous materials 210 and 220 may not be limited to copper powder, and instead, may be metal powder with higher conductivity and lower magnetic susceptibility than iron-based powder.

According to the present disclosure, as shown in FIG. 5, the heterogeneous material may be integrated into a partial region of a surface of the parent member 100. For example, the heterogeneous materials 210 and 220 may cover a center pole that protrudes from the center of the parent member 100, for example, in the form of a conventional copper cap. In this case, the heterogeneous materials 210 and 220 may be divided into a first heterogeneous material 210 covering an upper end of the center pole of the parent member 100, and a second heterogeneous material 220 covering a lateral surface of the center pole.

The yoke may be manufactured via simultaneous compression-molding of the parent member 100 formed of iron-based powder and the heterogeneous materials 210 and 220 formed of copper powder. Accordingly, as shown in FIG. 5, when the heterogeneous materials 210 and 220 are disposed on the surface of the parent member 100, an air gap may not be formed at a boundary 300 between the parent member 100 and the heterogeneous materials 210 and 220, and eddy current generated in the parent member 100 may be easily transmitted to the heterogeneous materials 210 and 220 while directly contacting all surfaces, as shown in FIG. 6.

The yoke may be manufactured via compression-molding of iron-based powder and copper powder, and thus, a pore P may be formed in the yoke, and an interface therebetween may function as resistance depending on powder particle size, e.g., diameter.

Accordingly, the yoke may have an enhanced output sound pressure level (SPL) as powder having a particle with a greater diameter is used to mold the yoke.

However, considering that a diameter of particles of general iron-based powder is equal to or less than 180 μm, the particle diameters of iron-based powder and copper powder may be limited to 180 μm or less. In addition, when the diameter of the particles of iron-based powder and copper powder is too low, a relatively high number of nonmagnetic pores may degrade an output sound pressure level (SPL).

Table 1 below shows the measurement result of a peak of an SPL that is manufactured while the particles of the diameter of iron-based powder and copper powder is changed. In this case, molding pressure of the iron-based powder and the copper powder was 600 MPa and annealing was performed for one hour and 30 minutes at temperature of 840° C. under an atmosphere of a mixture ratio of nitrogen:hydrogen of 9:1. Then, post-annealing was performed for 30 minutes at temperature of 250° C.

TABLE 1

| Division | Powder Diameter (μm) | SPL PEAK |
|---|---|---|
| No. 1 | 0 to 180 | 92.2 |
| No. 2 | 0 to 60 | 92.0 |
| No. 3 | 60 to 120 | 92.1 |
| No. 4 | 120 to 180 | 92.9 |

As seen from Table 1 above, based on an SPL peak value of sample No. 1 manufactured of general pure iron powder, samples Nos. 2 and 3 with relatively small diameter have low SPL peak values, and sample No. 4 with relatively large diameter has an enhanced SPL peak value. Accordingly, the particle diameter of the iron-based powder and the copper powder may be limited to 120 to 180 μm.

The heterogeneous materials 210 and 220 may have different effect of enhancing sound quality depending on a thickness thereof.

Table 2 below shows experiment data of an effect of enhancing sound quality depending on the thickness and shape of a heterogeneous material, and in this case, molding pressure of iron-based powder and copper powder was 600 MPa, and annealing was performed for one hour and 30 minutes at temperature of 840° C. under an atmosphere of a mixture ratio of nitrogen:hydrogen of 9:1. Then, post-annealing was performed for 30 minutes at temperature of 250° C., and an SPL standard deviation was calculated and shown in the range of 4 to 10 KHz.

TABLE 2

| Division | Form | Copper thickness (mm) | SPL standard deviation |
|---|---|---|---|
| No. 5 | Iron-based powder parent member + copper cap | 2.5 | 1.10 |
| No. 6 | Iron-based powder parent member | — | 1.14 |
| No. 7 | Iron-based powder parent member + copper powder heterogeneous material | 2.5 | 1.03 |
| No. 8 | Iron-based powder parent member + copper powder heterogeneous material | 5 | 0.98 |
| No. 9 | Iron-based powder parent member + copper powder heterogeneous material | 7.5 | 0.99 |

As seen from Table 2 above, comparing sample No. 5 using a conventionally applied copper cap and sample No. 6 of a yoke formed using only iron-based powder without formation of a heterogeneous material, sample No. 5 may have slightly enhanced SPL standard deviation compared with sample No. 6. Accordingly, it may be seen that there is a limit in enhancing sound quality in a high-frequency sound band due to an air gap between a copper cap and a parent member by simply applying the copper cap.

It may be seen that samples Nos. 7, 8, and 9 of forming heterogeneous materials 210 and 220 using copper powder on a surface of the parent member 100 have relatively much enhanced SPL standard deviation compared with sample No. 6. In addition, it may be seen that samples Nos. 8 and 9 of the heterogeneous materials 210 and 220 with a high thickness have an effect of highly enhancing an SPL standard deviation compared with sample No. 7 of the heterogeneous materials 210 and 220 with a thickness of 2.5 mm. However, it may be seen that samples Nos. 8 and 9 of the heterogeneous materials 210 and 220 with respective thicknesses of 5 mm and 7.5 mm have no particular difference in an effect of enhancing an SPL standard deviation.

Accordingly, the thickness of the heterogeneous materials 210 and 220 may be maintained at 7.5 mm or less, in detail, 5 to 7.5 mm.

A position of the heterogeneous material on the parent member is not limited to the aforementioned embodiment, and instead, may be embodied in various forms to divert a path of eddy current generated from the parent member.

FIGS. 7-9, 10A, and 10B are diagrams showing a yoke for a speaker according to another embodiment of the present disclosure.

As shown in FIG. 7, the yoke for the speaker according to another embodiment of the present disclosure may be configured in such a way that a heterogeneous material can be integrated into all surfaces of the parent member 100. In this case, the heterogeneous material may be divided into the first heterogeneous material 210 covering an upper end of a center pole, the second heterogeneous material 220 covering a lateral surface of the center pole, a third heterogeneous material 230 covering an upper surface of a base for supporting the center pole, a fourth heterogeneous material 240 covering a lateral surface of the base, and a fifth heterogeneous material 250 covering a lower surface of the base.

As shown in FIG. 8, the yoke for the speaker according to another embodiment of the present disclosure may be configured in such a way that a heterogeneous material can be integrated into a surface of the parent member 100 only in a specific direction. For example, the heterogeneous material may be formed only in a horizontal direction to a vibration direction of the diaphragm 50 configuring a speaker. In this case, the heterogeneous material may be divided into the second heterogeneous material 220 covering the lateral surface of the center pole of the yoke, and the fourth heterogeneous material 240 covering the lateral surface of the base for supporting the center pole. As such, when the heterogeneous materials 220 and 240 are disposed only in the horizontal direction to the vibration direction of the diaphragm 50, a path of eddy current generated in the parent member 100 may be short in the horizontal direction, and thus, force that influences in the vibration direction of the diaphragm 50 may become weak according to Fleming's rule and influence of the eddy current on sound quality may be reduced. In this case, the vibration direction of the diaphragm 50 may be an up and down direction based on FIG. 1. Accordingly, the second heterogeneous material 220 and the fourth heterogeneous material 240 that are disposed only in the horizontal direction to the vibration direction of the diaphragm 50 may be relatively long in an up and down direction based on FIG. 1.

On the other hand, when the heterogeneous material is in a perpendicular direction of the vibration direction of the diaphragm like the first heterogeneous material 210 shown in FIGS. 5 and 7, a length by which eddy current generated in the parent member 100 can be transmitted along the first heterogeneous material 210 may be increased, and thus, force that influences in the vibration direction of the diaphragm 50 may become relatively strong according to Fleming's rule, and the eddy current may influence on degradation in sound quality.

As shown in FIG. 9, a yoke for a speaker according to another embodiment of the present disclosure may be embodied by alternatively stacking the parent member 100 and a heterogeneous material 200 in a layer structure. For example, the yoke for the speaker may be embodied by separately forming the parent member 100 and the heterogeneous material 200 in the form of a plate and alternately stacking the parent member 100 and the heterogeneous material 200. For further explanation, the yoke for the speaker may be formed by forming the parent member 100 as a plurality of plate type parent members 110 and 120, forming the heterogeneous material 200 as a plurality of plate type heterogeneous materials 201 and 202, and by alternately disposing the plate type parent members 110 and 120 and the plate type heterogeneous materials 201 and 202. In this case, the plurality of plate type parent members 110 and 120 and the plurality of plate type heterogeneous materials 201 and 202 may be separately manufactured and stacked, but the yoke for the speaker may be embodied by alternately filling iron-based powder for forming the parent member 100 and copper powder for forming the heterogeneous material 200 in a mold and then integrally performing compression-molding on the resulting structure.

As such, the parent member 100 and the heterogeneous material 200 may be stacked to mold the yoke, and accordingly, eddy current generated from an entire volume of the yoke may be effectively controlled.

As shown in FIGS. 10A and 10B, a yoke for a speaker according to another embodiment of the present disclosure may be configured in such a way that at least one bar-type heterogeneous material 203 is in the parent member 100. Accordingly, the heterogeneous material 203 may be disposed in the form of a column in the parent member 100. In this case, like the embodiment shown in FIG. 8, the heterogeneous material 203 may also be in the horizontal direction to the vibration direction of the diaphragm 50 and a path of eddy current generated in the parent member 100 may be short, and thus, force that influences in the vibration direction of the diaphragm 50 may become weak according to Fleming's rule and influence of the eddy current on sound quality may be reduced.

A method of manufacturing a yoke according to an embodiment of the present disclosure will be described with reference to the drawings.

The method of manufacturing the yoke according to an embodiment of the present disclosure may include a powder preparing operation of preparing iron-based powder and copper powder, a molding operation of molding a parent member of the iron-based powder in the form of a yoke, in which the copper powder is added to at least a partial region of a surface and an internal portion of the parent member to form the heterogeneous material added to the parent member, and the parent member and the heterogeneous material are integrally molded together, and an annealing operation of performing annealing on the integrally molded parent member and heterogeneous material under a sintering atmosphere of the copper powder.

The powder preparing operation may be an operation of preparing the aforementioned iron-based powder and copper powder, and in this case, the particle diameter of the iron-based powder and the copper powder may be equal to or less than 180 μm, and in detail, powder with the particle diameter of 120 to 180 μm may be selectively prepared.

The molding operation may be an operation of integrally performing compression-molding on the iron-based powder and copper powder, and may be change in various forms according to the shape and arrangement of the parent member and the heterogeneous material.

FIGS. 11A, 11B, 11C, and 11D are diagrams showing a procedure of molding a yoke for a speaker according to an embodiment of the present disclosure.

For example, as shown in FIG. 11A, a plurality of molds M1 to M5, which are operated by hydraulic pressure to form a cavity, may be prepared in multi stages. In addition, a feeder F including an iron-based powder supplier S1 and an copper powder supplier S2 that supply iron-based powder and copper powder to a cavity in a mold, respectively, may be prepared.

As shown in FIG. 11B, a first mold M1 may be lowered to form a cavity, having a center pole of a yoke, between a second mold M2 and a third mold M3, and then, iron-based powder and copper powder may be filled at desired positions of an internal portion of the cavity using the iron-based powder supplier S1 and the copper powder supplier S2.

As shown in FIG. 11C, the first mold M1, the second mold M2, and the third mold M3 may be simultaneously lowered to form a cavity, having a base of the yoke, between a fourth mold M4 and a fifth mold M5.

Then, as shown in FIG. 11D, iron-based powder may be filled in the cavity between the fourth mold M4 and the fifth mold M5.

Accordingly, when iron-based powder and copper powder are completely filled in the form of a yoke, compression pressure may be supplied to the cavity of the filled mold to integrally perform compression-molding on the iron-based powder and the copper powder.

A series of procedures performed in the molding operation may not be limited to the procedures shown in FIGS. 11A, 11B, 11C, and 11D, and may be changed and embodied in various forms according to the shape and arrangement of the parent member and the heterogeneous material.

In addition, embodiments of the present disclosure are not limited to the case in which the heterogeneous material is molded by simultaneously filling the copper powder and the parent member, and thus, the copper powder may be molded in a bar type separately from the parent member, and then, may be inserted in an insert type while the parent member is filled to form the heterogeneous material.

The annealing operation may be an operation of annealing the compression-molded parent member and heterogeneous material under a sintering atmosphere of the copper powder to sinter the heterogeneous material and simultaneously to remove internal stress of the parent member, thereby enhancing the magnetic property of the yoke.

The iron-based powder for forming the parent member has a sintering temperature of 1100 to 1300° C. but has an annealing temperature for removing stress of 800 to 860° C. The copper powder for forming the heterogeneous material has a sintering temperature of 800 to 860° C. Accordingly, when annealing is performed under a sintering temperature atmosphere of the copper powder, an effect of sintering the heterogeneous material and simultaneously removing internal stress of the parent member via a single annealing process may be expected.

The annealing may be performed for one hour to one hour and 30 minutes at 830 to 840° C. When an annealing temperature and a time condition are lower and shorter than a proposed condition, magnetic property may be slightly enhanced, and when the annealing temperature and the time condition are higher and longer than the proposed condition, an effect of enhancing the magnetic property may not be further increased compared with the case in which thermal energy is further added.

Accordingly, the parent member and the heterogeneous material are simultaneously molded, and it may be possible to sinter the heterogeneous material and to remove internal stress of the parent member via a single annealing process, and thus, an effect of reducing the number of processes to manufacture a yoke compared with conventional processes may be expected.

According to the embodiments of the present disclosure, the yoke may be molded using iron-based powder and metal powder having higher conductivity and lower magnetic susceptibility than the iron-based powder, and thus, the pore in the yoke may reduce a path of eddy current to prevent an increase in the amplitude of eddy current which causes degradation of sound quality.

The copper powder for diverting a path of eddy current may be molded to be integrated into the surface and the internal portion of the iron-based powder, and thus, degradation of sound quality due to eddy current generated in the yoke may be prevented.

In addition, the iron-based powder and the metal powder may be simultaneously molded, and annealing may be performed in a condition of sintering the metal powder after molding to sinter the metal powder and to simultaneously remove internal stress of the parent member formed of the iron-based powder, thereby enhancing the magnetic property of the yoke.

Although the present disclosure has been shown and described with respect to specific embodiments, it will be apparent to those having ordinary skill in the art that the present disclosure may be variously modified and altered without departing from the spirit and scope of the present disclosure as defined by the following claims.

What is claimed is:

1. A yoke for a speaker comprising:

a parent member molded of an iron-based powder; and a heterogeneous material molded of a metal powder which has a higher conductivity and a lower magnetic susceptibility than the iron-based powder, wherein the heterogeneous material is integrally disposed on at least one of a part of a surface of the parent member, or an internal portion of the parent member, or both, wherein the heterogeneous material diverts an eddy current generated in the parent member, and wherein the heterogeneous material has a thickness of 5 to 7.5 mm.

2. The yoke of claim 1, wherein the iron-based powder and the metal powder have particles having a diameter equal to or less than 180 μm.

3. The yoke of claim 1, wherein each of the iron-based powder and the metal powder have particles having a diameter of 120 to 180 μm.

4. The yoke of claim 1, wherein the parent member and the heterogeneous material are alternately stacked in a layer structure.

5. The yoke of claim 1, wherein the heterogeneous material is integrally disposed on the parent member in a bar shape.

6. The yoke of claim 1, wherein the iron-based powder is a pure iron powder.

7. The yoke of claim 6, wherein the iron-based powder is an alloy powder including at least one element selected from the group consisting of silicon (Si), phosphorus (P), manganese (Mn), aluminium (Al), and nickel (Ni) in pure iron.

8. The yoke of claim 1, wherein the metal powder includes any one powder of silver (Ag), copper (Cu), gold (Au), chromium (Cr), aluminium (Al), tungsten (W), zinc (Zn), and brass or alloy powder thereof.

9. The yoke of claim 8, wherein the metal powder is a copper powder.

10. A method of manufacturing a yoke for a speaker, the method comprising steps of:

preparing an iron-based powder and a metal powder which has a higher conductivity and a lower magnetic susceptibility than the iron-based powder;

molding a parent member of the iron-based powder in the form of yoke, wherein the metal powder is added to at least one of a part of a surface of the parent member, or an internal portion of the parent member to form a heterogeneous material, such that the parent member and the heterogeneous material are molded to be integrated into each other; and annealing the integrally molded parent member and heterogeneous material under a sintering atmosphere of the metal powder, wherein the heterogeneous material has a thickness of 5 to 7.5 mm.

11. The method of claim 10, wherein the iron-based powder and the metal powder have particles with a diameter equal to or less than 180 μm, and wherein the step of molding includes molding the iron-based powder and the metal powder by compression molding.

12. The method of claim 11, wherein the iron-based powder is an alloy powder including pure iron powder or at least one element selected from the group consisting of silicon (Si), phosphorus (P), manganese (Mn), aluminium (Al), and nickel (Ni) in pure iron, and the metal powder includes any one powder of silver (Ag), copper (Cu), gold (Au), chromium (Cr), aluminium (Al), tungsten (W), zinc (Zn), and brass or alloy powder thereof.

13. The method of claim 10, wherein the step of annealing is performed for one hour to one hour and 30 minutes at 830 to 840□.

14. A speaker apparatus having a voice coil between a yoke and a magnet and transmitting vibration generated via an interaction between an electric field formed by supplying a current to the voice coil and a magnetic field formed by the magnet to a diaphragm to generate a sound, wherein the yoke includes:

a parent member molded of an iron-based powder; and a heterogeneous material molded of a metal powder having a higher conductivity and a lower magnetic susceptibility than the iron-based powder, wherein the heterogeneous material is integrally disposed on at least one of a part of a surface of the parent member, or an internal portion of the parent member, or both, and wherein the heterogeneous material diverts an eddy current generated in the parent member, wherein the heterogeneous material has a thickness of 5 to 7.5 mm.

15. The speaker apparatus of claim 14, wherein the heterogeneous material is at least partially disposed on the surface of the parent member, in a direction parallel to a vibration direction of the diaphragm.

16. The speaker apparatus of claim 14, wherein the parent member and the heterogeneous material are alternately stacked in a layer structure, and the heterogeneous material is disposed in a direction parallel to a vibration direction of the diaphragm.

17. The speaker apparatus of claim 14, wherein the heterogeneous material is integrally disposed on the parent member in a bar shape in a direction parallel to a vibration direction of the diaphragm.

* * * * *